US007057112B1

(12) United States Patent
Chen

(10) Patent No.: US 7,057,112 B1
(45) Date of Patent: Jun. 6, 2006

(54) ELECTRIC WIRE

(76) Inventor: Chi-Wen Chen, No. 105, Alley 27, Lane 143, Chun-Kung Rd., Taipei City (TW)

( * ) Notice: Subject to any disclaimer, the term of this patent is extended or adjusted under 35 U.S.C. 154(b) by 0 days.

(21) Appl. No.: 11/143,614

(22) Filed: Jun. 3, 2005

(51) Int. Cl.
*H01B 7/00* (2006.01)

(52) U.S. Cl. ..... 174/110 R; 174/113 R; 174/115

(58) Field of Classification Search ..... 174/36, 174/110 R, 113 R, 115, 116, 120 R, 120 AR
See application file for complete search history.

(56) References Cited

U.S. PATENT DOCUMENTS 2,583,025 A * 1/1952 Swift et al. ..... 174/117 R
4,543,448 A * 9/1985 Deurloo ..... 174/112
4,687,294 A * 8/1987 Angeles ..... 385/102
4,920,234 A * 4/1990 Lemke ..... 174/36
5,329,065 A * 7/1994 Marney et al. ..... 174/128.1
5,922,996 A * 7/1999 Ryeczek ..... 174/112
6,127,632 A * 10/2000 Oswald et al. ..... 174/120 R
6,498,300 B1 * 12/2002 Flick ..... 174/110 R

* cited by examiner

*Primary Examiner*—William H. Mayo, III
(74) *Attorney, Agent, or Firm*—Pearl Cohen Zedek Latzer, LLP

(57) ABSTRACT

An electric wire includes a core unit, and a sheath surrounding the core unit. The sheath includes an inner layer surrounding the core unit, and a transparent outer layer surrounding the inner layer. The outer layer has a cross-section including a plurality of first crest regions, and a plurality of second crest regions that are alternately disposed with the first crest regions. Each of the first crest regions cooperates with an adjacent one of the second crest regions to define a trough region therebetween. Each of the first crest regions has a thickness less than that of each of the second crest regions.

3 Claims, 4 Drawing Sheets

ELECTRIC WIRE

BACKGROUND OF THE INVENTION

1. Field of the Invention

This invention relates to an electric wire for conducting electric power to electrical devices, more particularly to an electric wire including a core unit and a sheath having an appealing appearance.

2. Description of the Related Art

Referring to FIG. 1, a typical electric wire 1 includes a core unit 10 and a plastic sheath 12 surrounding the core unit 10. The core unit 10 includes a plurality of insulated wires 11 parallel to each other along a central axis 13. Each of the insulated wires 11 has a plastic insulation layer 112 and a conductive core 111 surrounded by the plastic insulation layer 112.

Generally, manufacture of the conventional electric wire 1 is focused on achievement of conducting electricity and involves the steps of: applying the insulation layer 112 to each of the conductive cores 111 to form the insulated wires 11; arranging the insulated wires 11 to be parallel to each other, so as to form the core unit 10; and applying the sheath 12 to surround the core unit 10. The electric wire 1 is subsequently mounted on an electrical device for conducting electric power through a plug-and-socket unit. Hence, the electric wire 1 will be exposed outside the electrical device and is movable together therewith. In other words, the electric wire 1 has an influence on consumers' impression on the electrical device. Conventionally, the electric wire 1 is decorated by using a single-color sheath 12. Apparently, such dull and inflexible design of the electric wire 1 cannot satisfy the requirement of persons living in modern times for pursuing novel or fresh things. Therefore, there is a need in the art to provide an electric wire having an appealing appearance.

SUMMARY OF THE INVENTION

Therefore, the object of the present invention is to provide an electrical wire that is clear of the aforesaid drawback of the prior art.

According to this invention, an electric wire includes a core unit, and a sheath surrounding the core unit. The sheath includes an inner layer surrounding the core unit, and a transparent outer layer surrounding the inner layer. The outer layer has a cross-section including a plurality of first crest regions, and a plurality of second crest regions that are alternately disposed with the first crest regions. Each of the first crest regions cooperates with an adjacent one of the second crest regions to define a trough region therebetween. Each of the first crest regions has a thickness less than that of each of the second crest regions.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
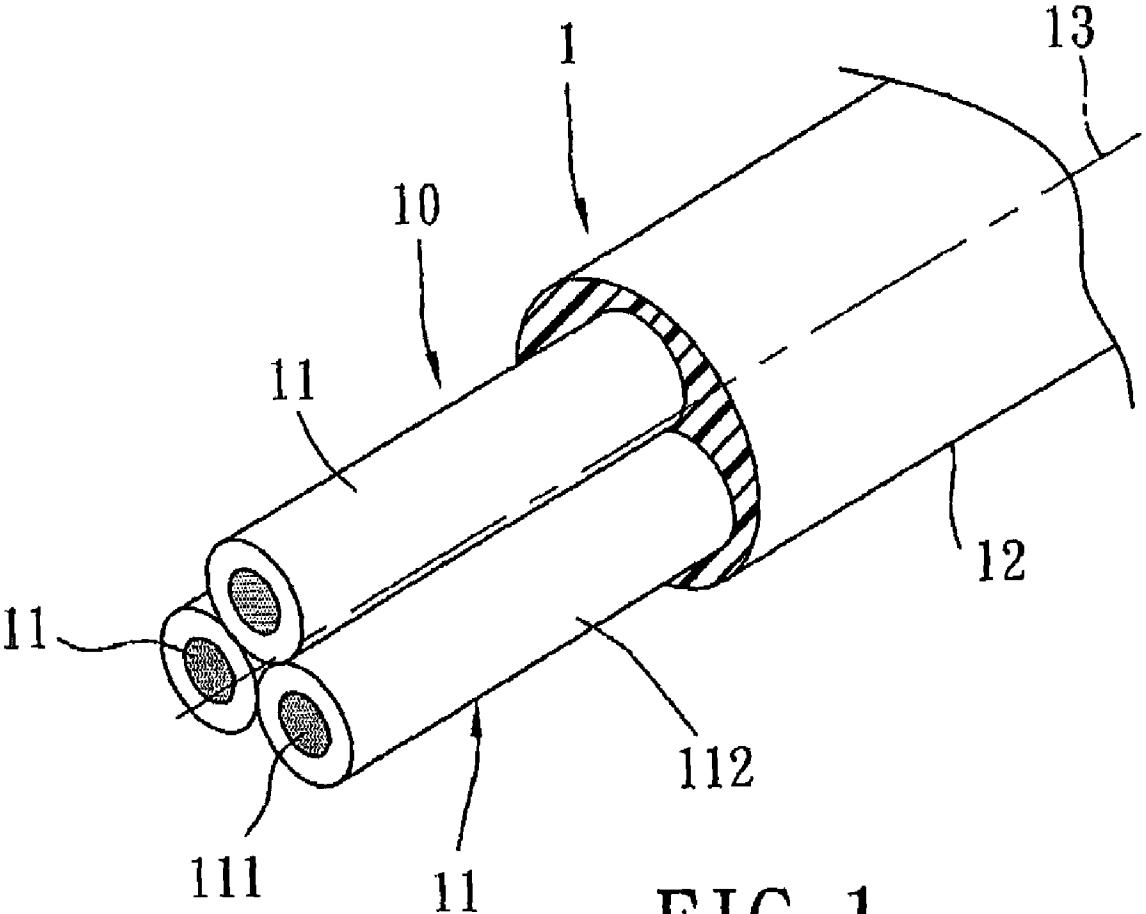
FIG. 1 PRIOR ART
FIG. 1 is a fragmentary cutaway perspective view to illustrate a conventional electric wire.
Figure 2:
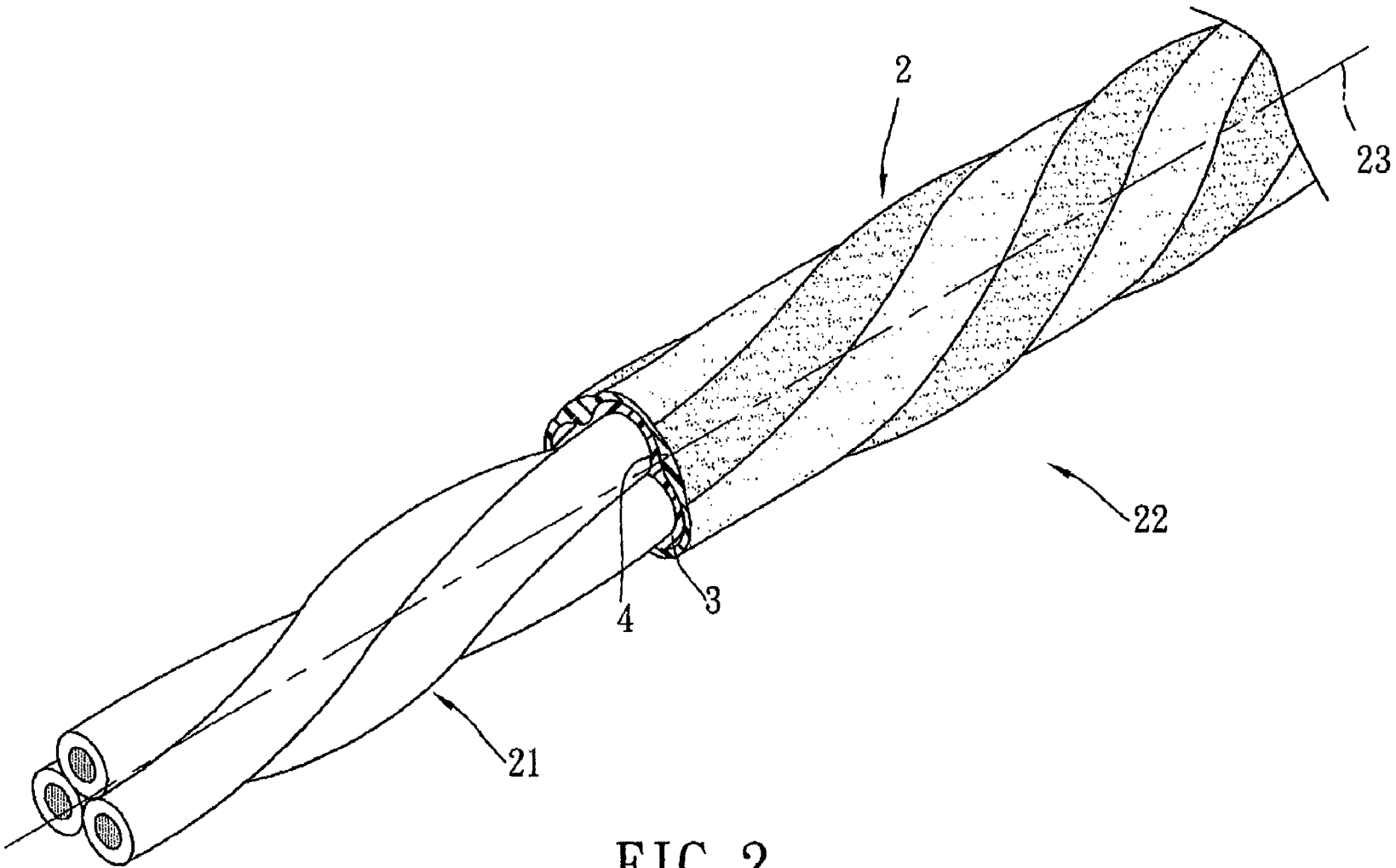
FIG. 2 is a fragmentary cutaway perspective view to illustrate the preferred embodiment of an electric wire according to the present invention.
Figure 3:
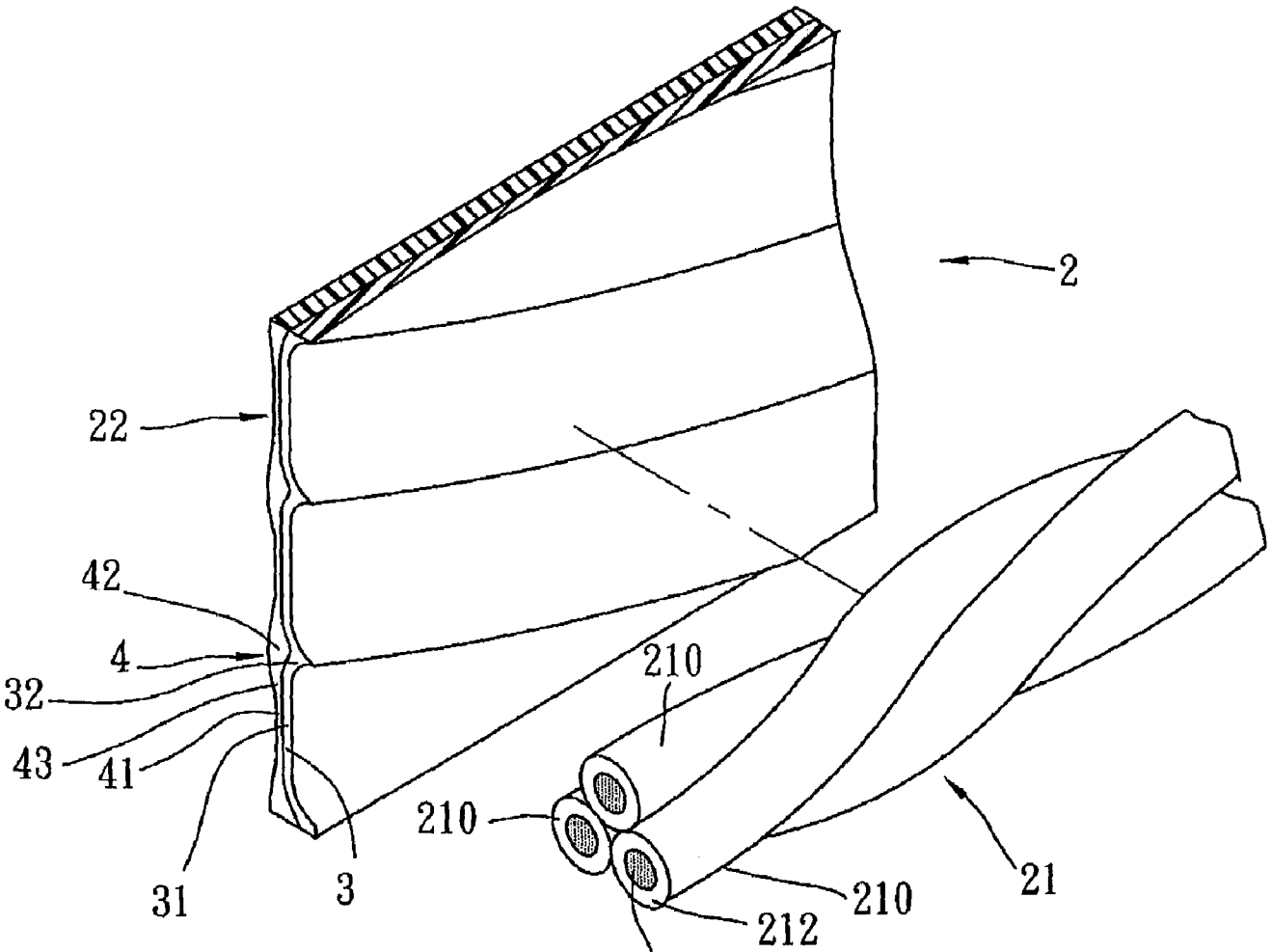
FIG. 3 is an exploded perspective view to illustrate structures of a core unit and a sheath of the electric wire of FIG. 2.
Figure 4:
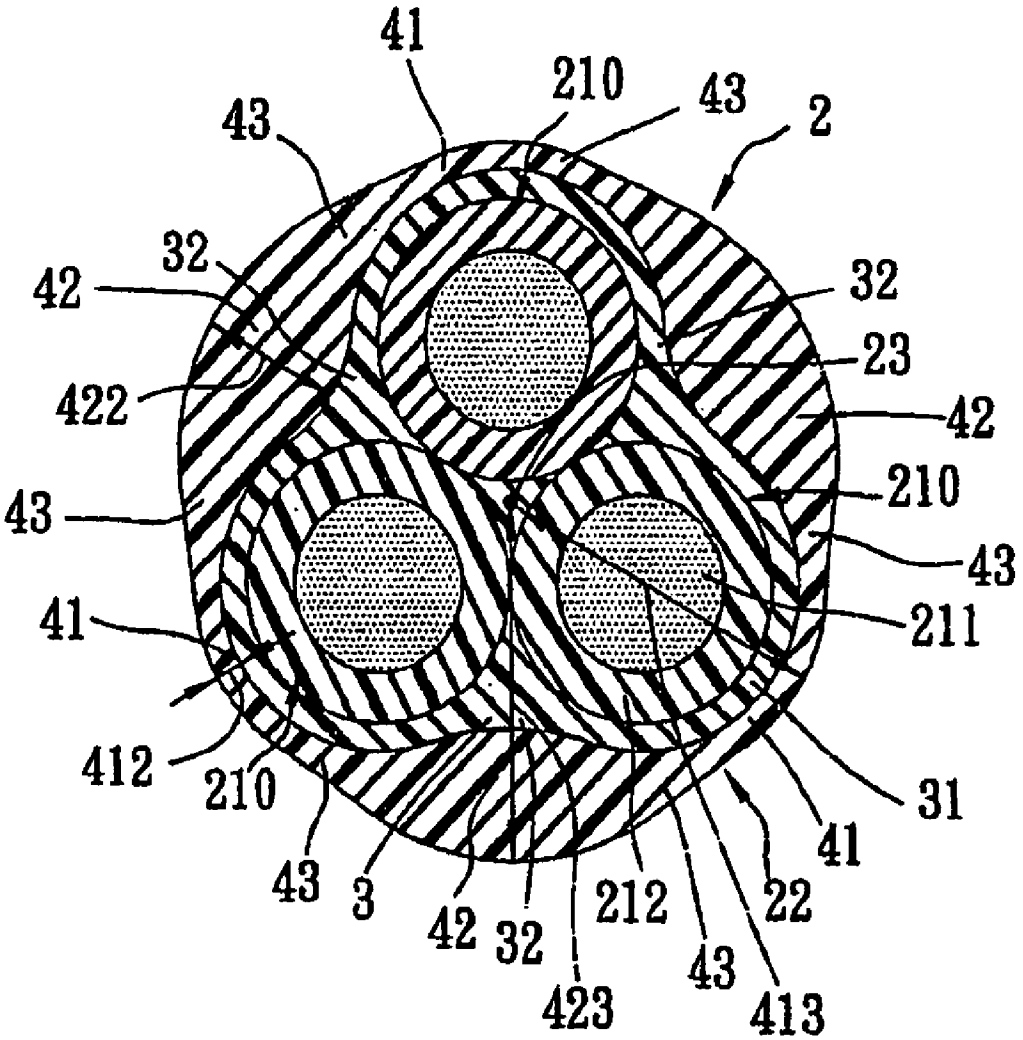
FIG. 4 is a cross-sectional view to illustrate structural arrangement of the core unit and the sheath of the electric wire of FIG. 2.

Referring to FIGS. 2, 3, and 4, the preferred embodiment of an electric wire 2 according to the present invention includes a core unit 21, and a sheath 22 surrounding the core unit 21. The sheath 22 includes an inner layer 3 surrounding the core unit 21, and a transparent outer layer 4 surrounding the inner layer 3. The outer layer 4 has across-section includes a plurality of first crest regions 41, and a plurality of second crest regions 42 that are alternately disposed with the first crest regions 41. Each of the first crest regions 41 cooperates with an adjacent one of the second crest regions 42 to define a trough region 43 therebetween. Each of the first crest regions 41 has a thickness 412 less than a thickness 422 of each of the second crest regions 42.

Preferably, the core unit 21 includes at least two sheathed wires 210 that are twisted together about a central axis 23. Each of the sheathed wires 210 includes an insulation layer 212 and a conductive core 211 surrounded by the insulation layer 212. More preferably, the core unit 21 includes one live wire and one neutral wire. Most preferably, the core unit 21 includes one live wire, one neutral wire, and one ground wire.

The outer layer 4 may be made from a translucent or transparent material, such as translucent or transparent PVC. In this preferred embodiment, the outer layer 4 is made from translucent milk-white PVC. In addition, preferably, the outer layer 4 is helically twisted about the central axis 23.

The inner layer 3 may be made from a color plastic material. Precisely, the inner layer 3 is made from a color PVC. Besides, the inner layer 3 preferably has a cross-section that includes a plurality of crest regions 31, and a plurality of trough regions 32. Each of the trough regions 32 is formed between two adjacent ones of the crest regions 31 of the inner layer 3. Each of the crest regions 31 of the inner layer 3 is registered with a respective one of the first crest regions 41 of the outer layer 4. Each of the trough regions 32 of the inner layer 3 is registered with a respective one of the second crest regions 42 of the outer layer 4. The distance 413 from each of the first crest regions 41 of the outer layer 4 to the central axis 23 is shorter than the distance 423 from each of the second crest regions 42 of the outer layer 4 to the central axis 23. More preferably, the inner layer 3 is helically twisted about the central axis 23.

According to the present invention, by virtue of thickness change and translucent or transparent character of the outer layer 4, and by virtue of the difference between the distance 413 from each of the first crest regions 41 of the outer layer 4 to the central axis 23 and the distance 423 from each of the second crest regions 42 of the outer layer 4 to the central axis 23, the electric wire 2 will have an appearance exhibiting gradation of the color of the inner layer 3, so as to improve the appealing character of the electric wire 2.

In addition, the structure of the outer layer 4 of the electric wire 2 of this invention is not restricted to helical shape. Other configuration modifications can be applied as long as the appearance of the electric wire 2 exhibits gradation of the color of the inner layer 3. For example, the outer layer 4 may include a plurality of straight strip portions and a plurality of recesses formed between two adjacent ones of the straight strip portions. The straight strip portions may differ in thickness.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

I claim:

1. An electric wire, comprising:

a core unit; and a sheath surrounding said core unit, and including an inner layer surrounding said core unit, and a transparent outer layer surrounding said inner layer, said outer layer having a cross-section including a plurality of first crest regions, and a plurality of second crest legions that are alternately disposed with said first crest regions, each of said first crest regions cooperating with an adjacent one of said second crest legions to define a trough region therebetween;

wherein each of said first crest regions has a thickness less than that of each of said second crest regions;

wherein said core unit comprises at least two sheathed wires that are twisted together about a central axis, each of said sheathed wires including an insulation layer and a conductive core surrounded by said insulation layer; and wherein said inner layer has a cross-section that comprises a plurality of crest regions and a plurality of trough regions, each of said trough regions being formed between two adjacent ones of said crest regions of said inner layer, each of said crest regions of said inner layer being registered with a respective one of said first crest regions of said outer layer, each of said trough regions of said inner layer being registered with a respective one of said second crest regions of said outer layer the distance from each of said first crest regions of said outer layer to said central axis being shorter than that from each of said second crest regions of said outer layer to said central axis.

2. The electric wire as claimed in claim 1, wherein said outer layer is helically twisted about the central axis.

3. The electric wire as claimed in claim 1, wherein said inner layer is helically twisted about said central axis.

* * * * *